US010243298B2

(12) United States Patent
Kawai et al.

(10) Patent No.: US 10,243,298 B2
(45) Date of Patent: Mar. 26, 2019

(54) CONNECTOR CONFIGURED TO BE FITTED INTO A COUNTERPART CONNECTOR

(71) Applicant: YAZAKI CORPORATION, Tokyo (JP)

(72) Inventors: Ryuji Kawai, Kakegawa (JP); Tomokazu Iwami, Kakegawa (JP); Michitake Masuda, Kakegawa (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/672,812

(22) Filed: Aug. 9, 2017

(65) Prior Publication Data

US 2018/0048091 A1 Feb. 15, 2018

(30) Foreign Application Priority Data

Aug. 10, 2016 (JP) ..... 2016-158044

(51) Int. Cl.
*H01R 13/58* (2006.01)
*H01R 12/65* (2011.01)
(Continued)

(52) U.S. Cl.
CPC ..... *H01R 13/5829* (2013.01); *H01R 12/65* (2013.01); *H01R 24/20* (2013.01);
(Continued)

(58) Field of Classification Search
CPC ..... H01R 2201/26; H01R 13/567; H01R 13/5841; H01R 24/28
(Continued)

(56) References Cited

U.S. PATENT DOCUMENTS 5,545,046 A * 8/1996 Masuda ..... B60K 1/04 439/142
8,597,039 B2 * 12/2013 Osawa ..... H01R 13/5227 439/205
(Continued)

FOREIGN PATENT DOCUMENTS

CN 103078210 A 5/2013
CN 203039140 U 7/2013
(Continued)

OTHER PUBLICATIONS

Communication dated Mar. 22, 2018, issued by the German Patent Office in counterpart German application No. 10 2017 213 595.6.
(Continued)

*Primary Examiner* — Tulsidas C Patel
*Assistant Examiner* — Marcus Harcum
(74) *Attorney, Agent, or Firm* — Sughrue Mion, PLLC

(57) ABSTRACT

A connector includes first terminals configured to be connected to first electric cables, a housing having terminal housing cylinder portions configured to contain the first terminals in parallel, terminal housing portions provided between the terminal housing cylinder portions, second terminals configured to be connected to second electric cables and to be contained in the terminal housing portions, and fasteners configured to fasten and fix terminal metal fittings connected to end portions of the first electric cables to the first terminals protruding from rear ends of the pair of terminal housing cylinder portions. By the fasteners, the terminal metal fittings are fixed to side faces of the first terminals from directions intersecting with axis directions of the first terminals, the side faces being opposite to faces of the first terminals which face each other.

3 Claims, 7 Drawing Sheets

(51) Int. Cl.

| | |
|---|---|
| ***H01R 24/20*** | (2011.01) |
| *H01R 13/52* | (2006.01) |
| *H01R 103/00* | (2006.01) |
| *H01R 4/34* | (2006.01) |
| *H01R 11/12* | (2006.01) |

(52) U.S. Cl.
CPC ..... *H01R 4/34* (2013.01); *H01R 11/12* (2013.01); *H01R 13/5205* (2013.01); *H01R 13/5213* (2013.01); *H01R 13/5812* (2013.01); *H01R 2103/00* (2013.01); *H01R 2201/26* (2013.01)

(58) Field of Classification Search
USPC ..... 439/34, 694
See application file for complete search history.

(56) References Cited

U.S. PATENT DOCUMENTS

| | | | | |
|---|---|---|---|---|
| 9,048,551 | B2 * | 6/2015 | Picaud | H01R 4/34 |
| 9,209,582 | B2 * | 12/2015 | Kashiwada | H01R 13/6315 |
| 9,263,826 | B2 * | 2/2016 | Wu | H01R 13/567 |
| 9,368,902 | B2 * | 6/2016 | Nakai | H01R 13/5202 |
| 9,472,882 | B2 * | 10/2016 | Kurita | B60L 11/1818 |
| 9,478,921 | B2 * | 10/2016 | Osawa | H01R 13/748 |
| 9,496,637 | B2 * | 11/2016 | Ichio | B60L 11/1818 |
| 9,531,100 | B2 * | 12/2016 | Fukushima | H01R 13/08 |
| 9,601,864 | B2 * | 3/2017 | Schmidt | H01R 13/5202 |
| 2013/0017713 | A1 * | 1/2013 | Asakuma | H01R 13/5833 439/459 |
| 2013/0224969 | A1 * | 8/2013 | Sasaki | B60L 11/1818 439/34 |
| 2015/0147918 | A1 * | 5/2015 | Matsuda | B60L 11/18 439/694 |
| 2016/0301152 | A1 | 10/2016 | Bertsch | |
| 2016/0365669 | A1 * | 12/2016 | Taylor | H01R 13/5841 |

FOREIGN PATENT DOCUMENTS

| | | | |
|---|---|---|---|
| CN | 205355412 | U | 6/2016 |
| DE | 3128483 | A1 | 3/1982 |
| DE | 10 2013 019 695 | A1 | 3/2018 |
| EP | 1 528 640 | B8 | 5/2007 |
| EP | 2 544 314 | A3 | 4/2013 |
| GB | 2 081 140 | A | 2/1982 |
| JP | 2013-84429 | A | 5/2013 |
| JP | 2014154374 | A | 8/2014 |
| TW | 201320496 | A1 | 5/2013 |

OTHER PUBLICATIONS

Communication dated Aug. 7, 2018, issued by the Japanese Patent Office in counterpart Japanese Application No. 2016-158044.

Office Action dated Nov. 5, 2018 by the State Intellectual property Office of P.R. China in counterpart Chinese Patent Application No. 201710680540.2.

* cited by examiner

PRIOR ART

CONNECTOR CONFIGURED TO BE FITTED INTO A COUNTERPART CONNECTOR

CROSS REFERENCE TO RELATED APPLICATIONS

This application is based on Japanese Patent Application (No. 2016-158044) filed on Aug. 10, 2016, the contents of which are incorporated herein by reference.

BACKGROUND OF THE INVENTION

1. Field of the Invention

The present invention relates to a connector which can be fitted into a counterpart connector.

2. Description of the Related Art

When a feeding connector which serves as a counterpart connector is fitted into a charging connector assembled to a body of a vehicle, a battery mounted in the vehicle such as an electric vehicle or a plug-in hybrid electric vehicle is charged.

There is a charging connector configured as follows. That is, as shown in FIG. 9, electric cable connecting portions 503 are mounted respectively on rear end portions of two terminals 502 which protrude rearward from a housing 501. Power cables 504 are electrically connected to the terminals 502 through the electric cable connecting portions 503. Thus, the power cables 504 are led out in a direction perpendicular to axis directions of the terminals 502 (e.g. see JP-A-2013-84429).

In the aforementioned charging connector, the power cables 504 can be routed compactly at the rear of the housing 501. However, holders 506 by which terminals connected to signal lines 505 led out of the housing 501 are held in the housing 501 interfere with the cable connecting portions 503.

Therefore, in order to perform assembling work for attaching/detaching the terminals of the signal lines 505 to/from the housing 501 and routing the signal lines 505 etc., the electric cable connecting portions 503 have to be removed. For this reason, an improvement in workability has been desired.

SUMMARY OF THE INVENTION

The invention has been accomplished in consideration of the aforementioned circumstances. An object of the invention is to provide a connector in which assembling work can be performed easily while compactness is maintained.

In order to achieve the aforementioned object, the connector according to the invention is characterized by the following configurations (1) to (3).

(1) A connector including:

a pair of first terminals configured to be connected to first electric cables;

a housing having a pair of terminal housing cylinder portions configured to contain the pair of first terminals in parallel with each other;

a pair of terminal housing portions provided between the pair of terminal housing cylinder portions;

second terminals configured to be connected to second electric cables and to be contained in the pair of terminal housing portions; and fasteners configured to fasten and fix terminal metal fittings connected to end portions of the first electric cables to the pair of first terminals protruding from rear ends of the pair of terminal housing cylinder portions, wherein by the fasteners, the terminal metal fittings are fixed to side faces of the pair of first terminals from directions intersecting with axis directions of the pair of first terminals, the side faces being opposite to faces of the pair of first terminals which face each other.

(2) The connector according to the aforementioned configuration (1), further including: a terminal holder having a pair of holder portions configured to cover connection places between the pair of first terminals and the end portions of the first electric cables respectively.

(3) The connector according to the aforementioned configuration (1) or (2), wherein the housing is configured to be fixed to a body of a vehicle, the first electric cables serving power cables connected to a power supply are connected to the pair of first terminals, and the second electric cables serving signal lines are connected to the second terminals, so that the power supply can be charged when a feeding connector is fitted to the connector.

The connector having the aforementioned configuration (1) has a structure in which the terminal metal fittings connected to the end portions of the first electric cables are fixed to the side faces of the first terminals from the sides intersecting with the axis directions of the first terminals by the fasteners, the side faces being opposite to the faces of the first terminals which face each other.

Therefore, the first electric cables can be easily led out downward or upward differently from the axis directions of the first terminals. Thus, rearward protruding dimensions of the housing can be suppressed so that the connector can be made compact.

In addition, as viewed from a rear end side of the housing, the connection places between the first terminals and the terminal metal fittings or the first electric cables are disposed in positions externally separate from the terminal housing portions provided between the terminal housing cylinder portions. Accordingly, the second terminals can be attached/detached to/from the terminal housing portions in a state in which the first terminals and the terminal metal fittings are fixed to each other respectively. In addition, the second electric cables connected to the second terminals can be suppressed from interfering with the connection places between the first terminals and the terminal metal fittings. Thus, work for assembling the second terminals to the terminal housing portions of the housing can be performed easily.

In the connector having the aforementioned configuration (2), the connection places between the first terminals and the end portions of the first electric cables can be protected by the holder portions of the terminal holder respectively. In addition, the second electric cables led out of the terminal housing portions can be prevented and protected from touching the connection places between the first terminals and the end portions of the first electric cables.

In the connector having the aforementioned configuration (3), the power cables can be let out downward or upward differently from the axis directions of the first terminals. Thus, the rearward protruding dimensions of the housing can be suppressed so that the connector can be made compact. Therefore, when the housing is fixed as a charging connector to the body of the vehicle, the power cables can be routed to bypass a structure of the vehicle, and the signal lines connected to the second terminals can be routed easily.

According to the invention, it is possible to provide a connector in which assembling work can be performed easily while compactness is maintained.

The invention has been described above briefly. When an undermentioned mode (hereinafter referred to as "embodiment") for carrying out the invention is further read through with reference to the accompanying drawings, details of the invention can be made clearer.

DETAILED DESCRIPTION OF THE EXEMPLARY EMBODIMENTS

An embodiment of the invention will be described below by way of example with reference to the drawings.

Figure 1A:
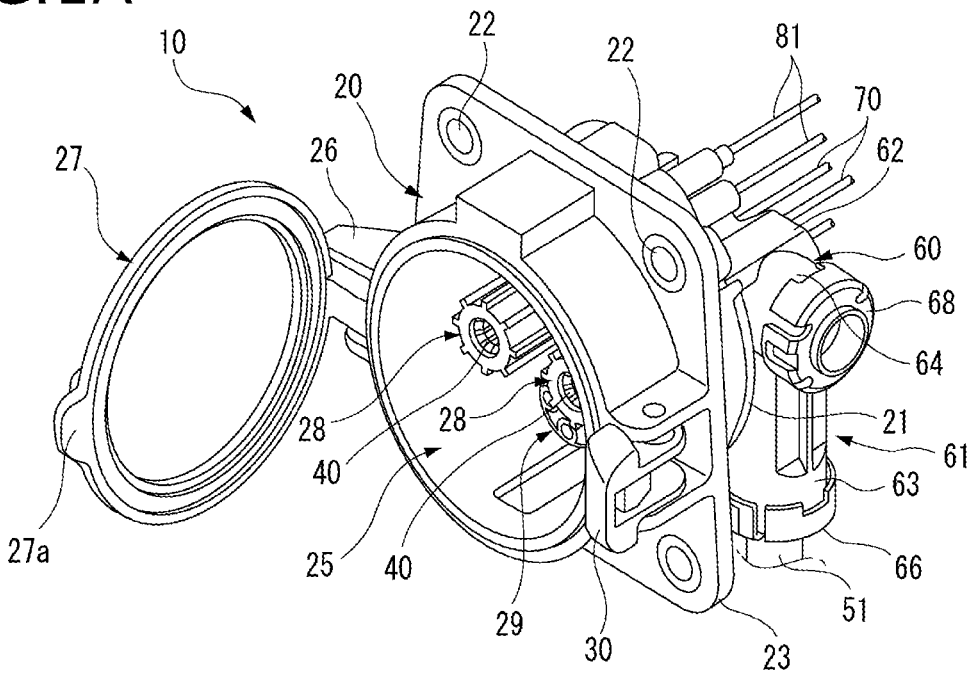
FIGS. 1A and 1B are views showing a connector according to an embodiment of the invention, FIG. 1A being a perspective view seen from a front side, FIG. 1B being a perspective view seen from a rear side.
Figure 1B:
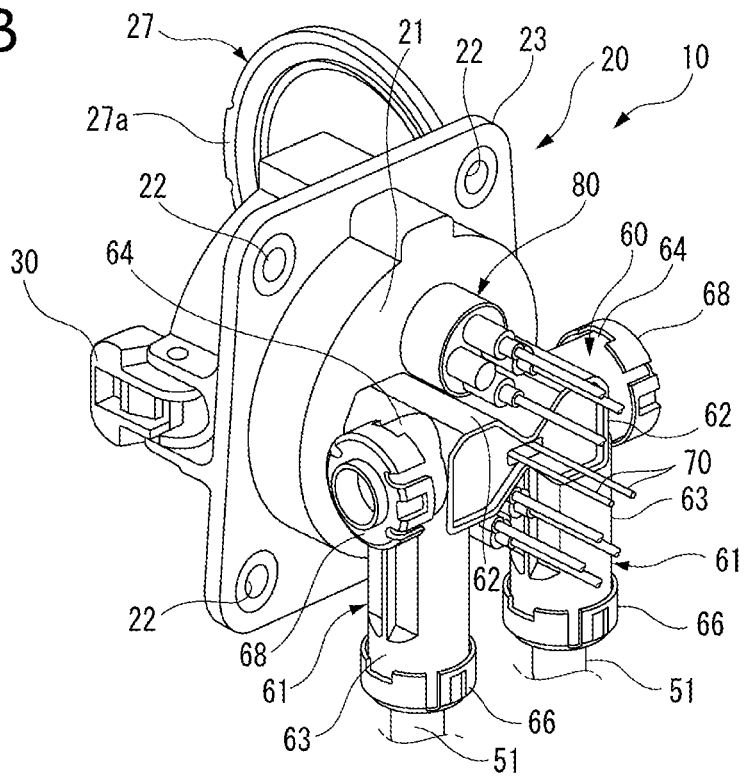
Figure 2:
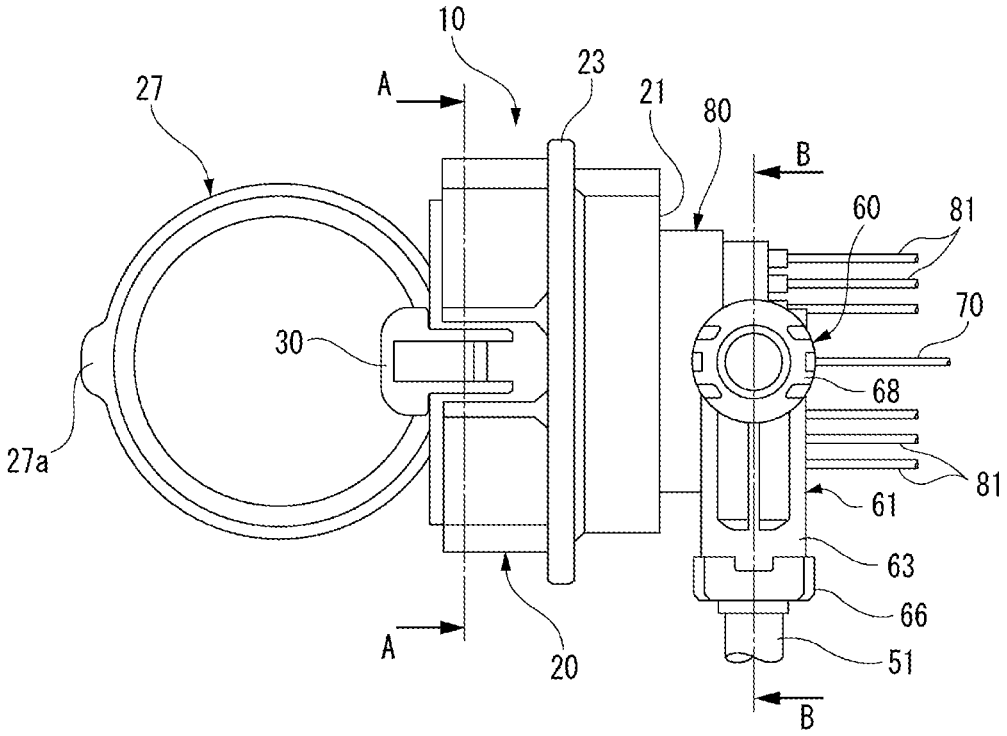
FIG. 2 is a side view showing the connector according to the embodiment.
Figure 3A:
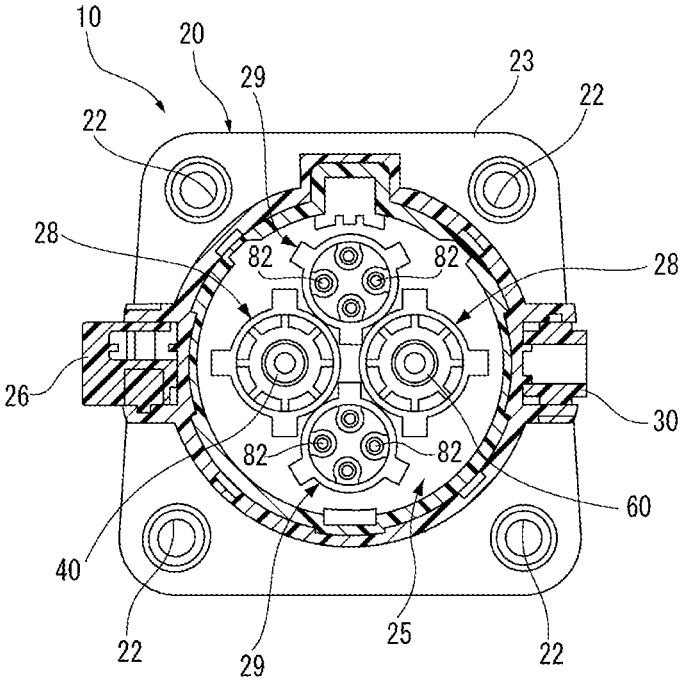
FIG. 3A is a sectional view taken along a line A-A in FIG. 2.
Figure 3B:
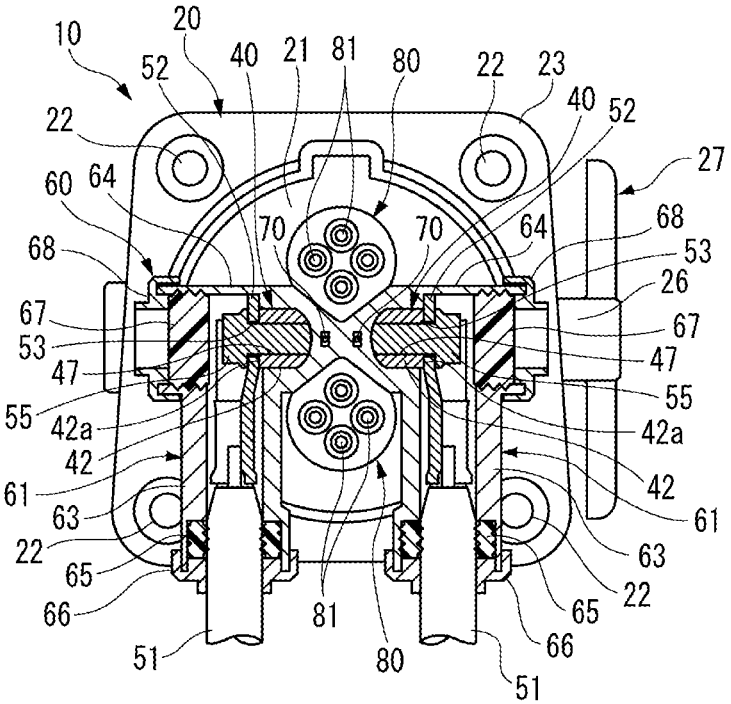
FIG. 3B is a sectional view taken along a line B-B in FIG. 2.
Figure 4:
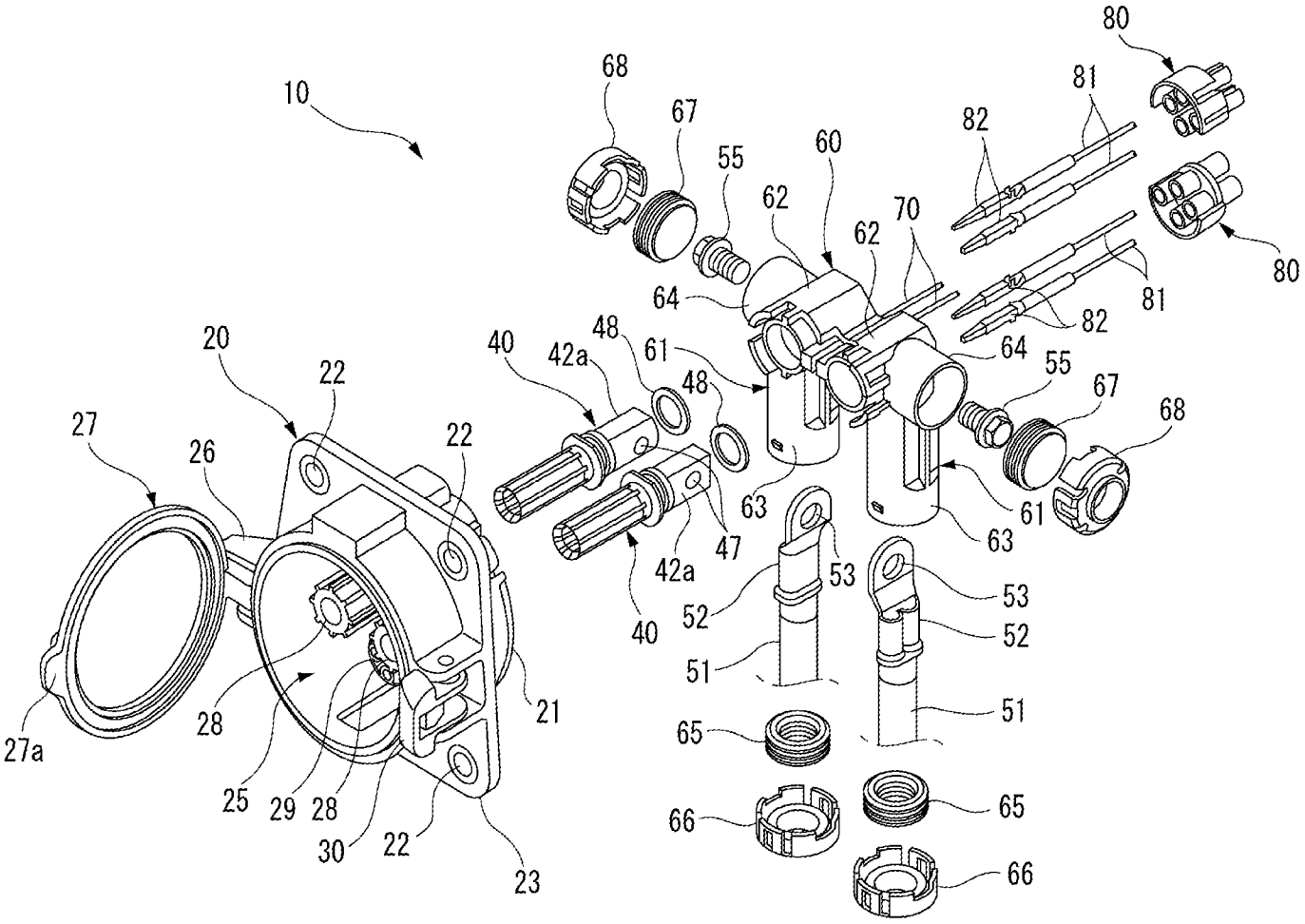
FIG. 4 is an exploded perspective view seen from the front side for explaining the configuration of the connector according to the embodiment.
Figure 5:
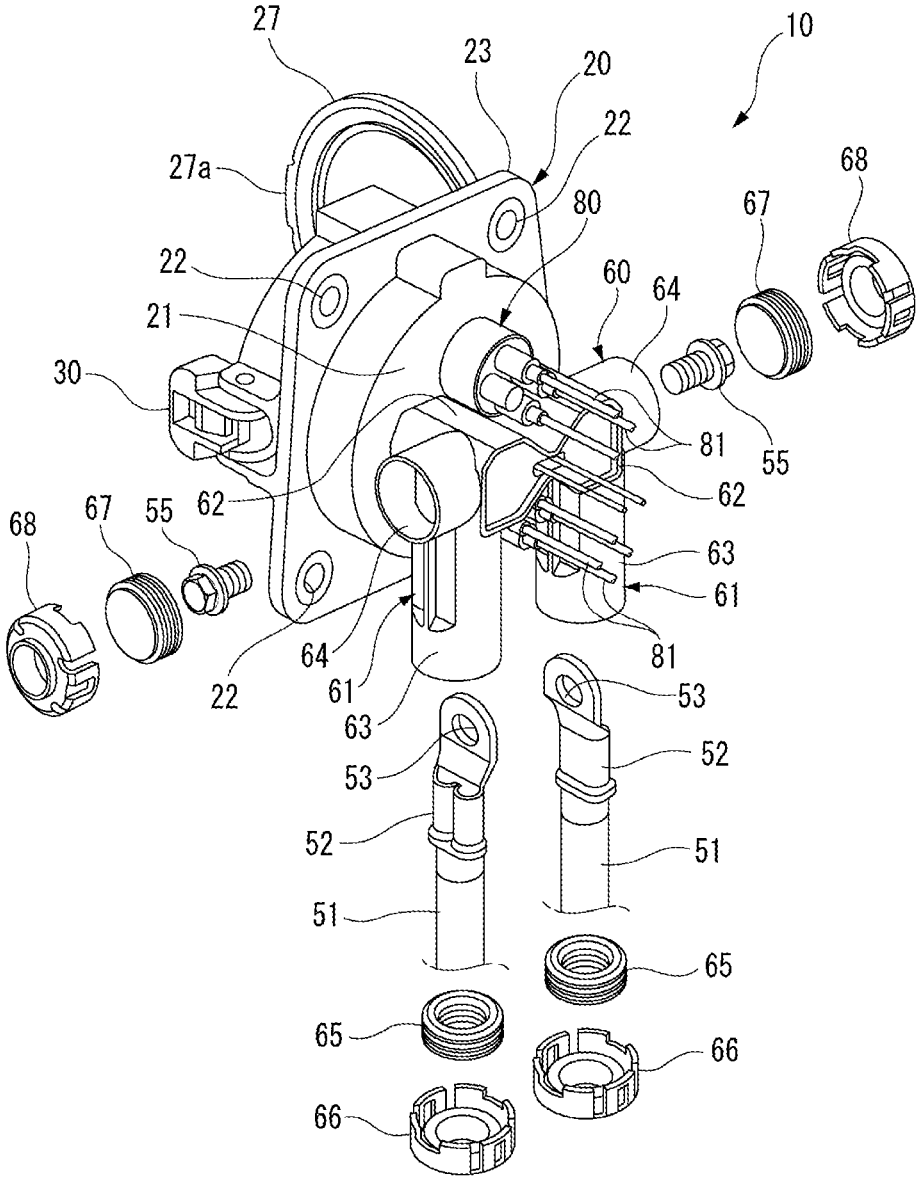
FIG. 5 is an exploded perspective view seen from the rear side for explaining the configuration of the connector according to the embodiment.

FIGS. 1A and 1B are views showing a connector according to an embodiment of the invention. FIG. 1A is a perspective view seen from a front side. FIG. 1B is a perspective view seen from a rear side. FIG. 2 is a side view showing the connector according to the embodiment. FIG. 3A is a sectional view taken along a line A-A in FIG. 2. FIG. 3B is a sectional view taken along a line B-B in FIG. 2. FIG. 4 is an exploded perspective view seen from the front side for explaining the configuration of the connector according to the embodiment. FIG. 5 is an exploded perspective view seen from the rear side for explaining the configuration of the connector according to the embodiment.

As shown in FIGS. 1A and 1B, FIG. 2, FIGS. 3A and 3B and FIGS. 4 and 5, the connector 10 according to the embodiment is provided with a housing 20, charging terminals (first terminals) 40, a terminal holder 60, and rear holders 80.

The connector 10 is a charging inlet connector assembled to a vehicle body of a vehicle mounted with a battery, such as an electric vehicle (EV) or a plug-in hybrid electric vehicle (PHEV). When the battery of the vehicle is charged, a feeding connector on a feeding device (not shown) side is fitted to the connector 10. In the state in which the feeding connector is fitted to the connector 10, electric power is fed from the feeding device toward the vehicle side so that the battery can be charged.

The housing 20 is formed out of an insulating synthetic resin. The housing 20 formed thus is shaped like a bottomed cylinder which has a bottom plate portion 21 on its rear end side. A fixation flange 23 having insertion holes 22 is formed on an outer circumference of the bottomed cylinder. The housing 20 is fitted from the bottom plate portion 21 side into an attachment hole which is formed in a vehicle body panel constituting the body of the vehicle. Bolts are inserted through the insertion holes 22 of the fixation flange 23 to be screwed into threaded holes of the vehicle body panel. Thus, the housing 20 is fastened and fixed to the vehicle body panel.

The housing 20 has a fitting recess 25 open on its front end side. A housing of the feeding connector is fitted into the fitting recess 25. The housing 20 has a cap 27 which is coupled to a portion of an edge portion of the fitting recess 25 by a hinge portion 26. The cap 27 is swung on the hinge portion 26. Thus, the fitting recess 25 is open/closed by the cap 27.

A lock mechanism 30 for locking a lock pawl 27*a* formed at an edge portion of the cap 27 is provided in an opposite position to the hinge portion 26 in an edge portion of the front end of the housing 20. Therefore, in the cap 27, the lock pawl 27*a* can be locked by the lock mechanism 30. Thus, when the lock pawl 27*a* of the cap 27 is locked by the lock mechanism 30, the housing 20 is maintained at a closed state by the cap 27.

A pair of terminal housing cylinder portions 28 protruding inside the fitting recess 25 are formed in the bottom plate portion 21 of the housing 20. In addition, a pair of terminal housing portions 29 are formed in upper and lower positions between the terminal housing cylinder portions 28 in the bottom plate portion 21 of the housing 20 (see FIG. 3A).

Each of the charging terminals 40 is a charging terminal through which a charging current is made to flow. For example, the charging terminals 40 are formed out of a conductively electric metal material such as copper or a copper alloy etc. The charging terminals 40 are fitted into the terminal housing cylinder portions 28 from the rear side of the housing 20 to be housed in parallel in the housing 20 in a horizontal plane.

Figure 6:
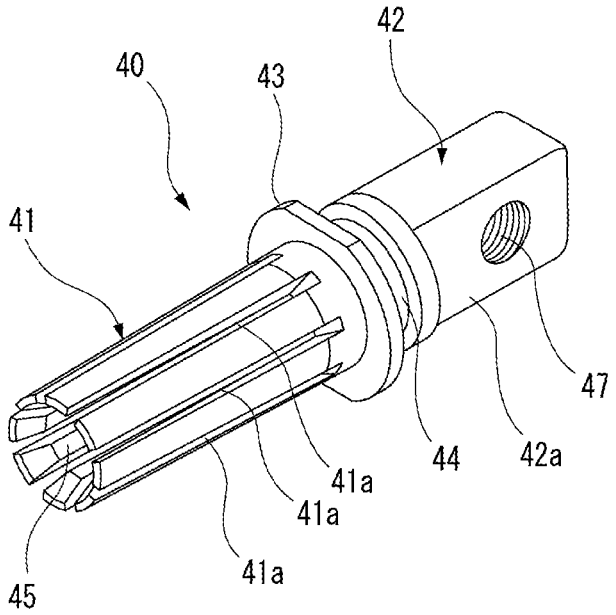
FIG. 6 is a perspective view of a charging terminal constituting the connector according to the embodiment.

As shown in FIG. 6, each of the charging terminals 40 has a front end-side terminal connecting portion 41, a rear end-side cable connecting portion 42, and a flange portion 43. The flange portion 43 juts out of an outer circumference of the charging terminal 40 so as to extend circumferentially between the terminal connecting portion 41 and the cable connecting portion 42.

Each of the terminal connecting portions 41 of the charging terminals 40 is formed substantially into a circular cylinder having a fitting hole 45. A plurality of slits 41*a* each extending in an axis direction are formed in the terminal connecting portion 41 so that the terminal connecting portion 41 is divided into a plurality of parts circumferentially. Charging terminals of the feeding connector which is a counterpart connector are fitted into the fitting holes 45 of the terminal connecting portions 41. Thus, the charging terminals 40 are electrically connected to the charging terminals of the feeding connector fitted to the fitting holes 45.

Each of the cable connecting portions 42 of the charging terminals 40 is formed substantially into a quadrilateral prism. A threaded hole 47 is formed in the cable connecting portion 42 to extend in a horizontal direction perpendicular to an axis of the charging terminal 40. The cable connecting portion 42 has a connection face 42*a* at a portion of a circumferential face of the cable connecting portion 42. The connection face 42*a* is formed as a smooth face. The threaded hole 47 is open to the connection face 42a. In the cable connecting portion 42 of the charging terminal 40, a groove portion 44 extending circumferentially is formed in a position adjacent to the flange portion 43. An 0-ring 48 is mounted on the groove portion 44 (see FIG. 4).

In the charging terminals 40, power cables (first electric cables) 51 are connected to the cable connecting portions 42. The power cables 51 are electric cables which are connected to the battery of the vehicle and through which a large current is made to flow. Terminal metal fittings 52 are crimp-connected to end portions of the power cables 51. For example, the terminal metal fittings 52 are made of a conductively electric metal material such as copper or a copper alloy etc. Each of the terminal metal fittings 52 has an attachment hole 53. A fastening bolt (fastener) 55 is inserted through the attachment hole 53.

The fastening bolts 55 inserted through the attachment holes 53 are screwed into the threaded holes 47. The terminal metal fittings 52 are fastened and fixed to the cable connecting portions 42 of the charging terminals 40. That is, the terminal metal fittings 52 of the power cables 51 are fixed to the connection faces 42*a* from sides perpendicular to the axis directions of the charging terminals 40. The connection faces 42*a* are side faces opposite to the faces of the cable connecting portions 42 of the charging terminals 40 which face each other. Thus, the charging terminals 40 and the power cables 51 are electrically to each other respectively. Incidentally, the terminal metal fittings 52 are fixed from the sides perpendicular to the axis directions of the charging terminals 40 by the fastening bolts 55 respectively in the embodiment. However, the fastening bolts 55 may be fastened and fixed to the attachment holes 53 so as to intersect with the axis directions of the charging terminals 40 from sides having some inclination angles therewith.

The terminal holder 60 is made of an insulating synthetic resin. The terminal holder 60 has a pair of holder portions 61 which cover connection places between the charging terminals 40 and the power cables 51. Each of the holder portions 61 has a terminal inserting cylinder portion 62, an electric cable inserting cylinder portion 63 and a bolt inserting cylinder portion 64. In addition, thermistors (not shown) for detecting temperatures of the charging terminals 40 are provided between the holder portions 61 in the terminal holder 60. Electric cables 70 connected to the thermistors are led rearward from the terminal holder 60.

Front sides of the terminal inserting cylinder portions 62 are open. The cable connecting portions 42 of the charging terminals 40 on which the 0-rings 48 are mounted are inserted into the terminal inserting cylinder portions 62 respectively.

Lower sides of the electric cable inserting cylinder portions 63 are open. The end portions of the power cables 51 to which the terminal metal fittings 52 have been connected are inserted into the electric cable inserting cylinder portions 63. When the power cables 51 are inserted into the electric cable inserting cylinder portions 63, the terminal metal fittings 52 are disposed on the sides of the connection faces 42*a* in the cable connecting portions 42 of the charging terminals 40 which have been inserted in the terminal inserting cylinder portions 62. In addition, rubber stoppers 65 and rubber stopper holding fixtures 66 are mounted in advance on the power cables 51 inserted into the electric cable inserting cylinder portions 63. The rubber stoppers 65 are fitted into the electric cable inserting cylinder portions 63, and further, the rubber stopper holding fixtures 66 are fixed to end portions of the electric cable inserting cylinder portions 63. Thus, the electric cable inserting cylinder portions 63 in which the power cables 51 have been inserted can be made waterproof by the rubber stoppers 65.

Sides of the bolt inserting cylinder portions 64 are open. The fastening bolts 55 are inserted into the bolt inserting cylinder portions 64. The fastening bolts 55 which have been inserted in the bolt inserting cylinder portions 64 are inserted through the attachment holes 53 in the terminal metal fittings 52 of the power cables 51 which have been inserted in the electric cable inserting cylinder portions 63. Then, the fastening bolts 55 are screwed into the threaded holes 47 in the cable connecting portions 42 of the charging terminals 40 which have been inserted in the terminal inserting cylinder portions 62. Thus, the terminal metal fittings 52 are connected to the connection faces 42*a* of the cable connecting portions 42. That is, the power cables 51 are fixed and connected to the charging terminals 40 from the sides by the fastening bolts 55. The connection places between the power cables 51 and the charging terminals 40 are covered with the holder portions 61 of the terminal holder 60. In addition, rubber stoppers 67 are fitted into the bolt inserting cylinder portions 64, and further, caps 68 are fixed to end portions of the bolt inserting cylinder portions 64. Thus, the bolt inserting cylinder portions 64 in which the fastening bolts 55 have been inserted are made waterproof by the rubber stoppers 67.

The rear holders 80 are mounted in advance on signal lines (second electric cables) 81. The signal lines 81 are electric cables which are connected to signal lines of the counterpart connector so as to transmit/receive signals and exchange communication between the power feeding device and the vehicle. Signal terminals (second terminals) 82 are crimp-connected to end portions of the signal lines 81 (see FIG. 4). The signal terminals 82 of the signal lines 81 are inserted into the respective terminal housing portions 29 of the housing 20. The rear holders 80 are put and mounted on the terminal housing portions 29 in which the signal terminals 82 have been inserted. Thus, the signal terminals 82 are held in the terminal housing portions 29 of the housing 20, and the signal lines 81 are led rearward from the housing 20. Signal terminals crimp-connected to end portions of the signal lines of the feeding connector which serves as the counterpart connector are connected to the signal terminals 82 held in the terminal housing portions 29 of the housing 20. Thus, the signal lines 81 of the connector 10 and the signal lines of the counterpart connector are electrically conductively to each other respectively so that the transmission/reception of signals or the exchange of communication can be performed.

Here, the terminal metal fittings 52 which have been connected to the end portions of the power cables 51 are fixed to the connection faces 42*a* from the sides perpendicular to the axis directions of the charging terminals 40 by the fastening bolts 55. The connection faces 42*a* are the side faces opposite to the faces of the charging terminals 40 which face each other. Accordingly, the connection places between the charging terminals 40 and the terminal metal fittings 52 of the power cables 51 or the power cables 51 can be disposed in positions externally separate from the terminal housing portions 29 which have been provided between the terminal housing cylinder portions 28, as viewed from the rear end side of the housing 20 (see FIG. 3B). Thus, the signal lines 81 can be led rearward from the housing 20 without interfering with the connection places between the charging terminals 40 and the power cables 51 and the terminal holder 60 covering the connection places.

In addition, the connection places between the charging terminals 40 and the power cables 51 and the terminal holder 60 covering the connection places are not disposed on rear sides of the rear holders 80. Therefore, the rear holders 80 can be attached/detached in a state in which the charging terminals 40 and the power cables 51 have been connected to each other respectively. Thus, the signal terminals 82 can be attached/detached to/from the terminal housing portions 29.

According to the connector 10 according to the embodiment as described above, the terminal metal fittings 52 connected to the end portions of the power cables 51 are fixed to the connection faces 42*a* from the sides perpendicular to the axis directions of the charging terminals 40 by the fastening bolts 55. The connection faces 42*a* are opposite to the faces of the charging terminals 40 which face each other. Therefore, the power cables 51 can be easily led out downward differently from the axis directions of the charging terminals 40. Thus, rearward protruding dimensions of the housing 20 can be suppressed so that the connector 10 can be made compact.

In addition, as viewed from the rear end side of the housing 20, the connection places between the charging terminals 40 and the terminal metal fittings 52 of the power cables 51 or the power cables 51 are disposed in the positions externally separate from the terminal housing portions 29 provided between the terminal housing cylinder portions 28. Accordingly, the signal terminals 82 can be attached/detached to/from the terminal housing portions 29 easily in the state in which the charging terminals 40 and the terminal metal fittings 52 are fixed to each other respectively. In addition, the signal lines 81 connected to the signal terminals 82 can be suppressed from interfering with the connection places between the charging terminals 40 and the terminal metal fittings 52 of the power cables 51. Thus, work for assembling the signal terminals 82 to the terminal housing portions 29 of the housing 20 can be performed easily.

Particularly, the power cables 51 are led out downward differently from the axis directions of the charging terminals 40. Thus, the rearward protruding dimensions of the housing 20 can be suppressed so that the connector 10 can be made compact. Therefore, the power cables 51 can be routed to bypass a structure of the vehicle when the housing 20 is fixed as the charging connector to the body of the vehicle. Thus, the signal lines 81 connected to the signal terminals 82 can be routed easily.

In addition, according to the connector 10 according to the embodiment, the connection places between the charging terminals 40 and the end portions of the power cables 51 can be protected by the holder portions 61 of the terminal holder 60 respectively. In addition, the signal lines 81 led from the terminal housing portions 29 can be prevented and protected from touching the connection places between the charging terminals 40 and the end portions of the power cables 51.

In addition, by the rubber stoppers 65 and the rubber stoppers 67 which are fitted to the electric cable inserting cylinder portions 63 and the bolt inserting cylinder portions 64 respectively, the connection places between the charging terminals 40 and the end portions of the power cables 51 can be made waterproof. However, when waterproofness in the terminal holder 60 is unnecessary, the rubber stoppers 65 and the rubber stoppers 67 fitted to the electric cable inserting cylinder portions 63 and the bolt inserting cylinder portions 64 respectively can be removed.

Figure 7:
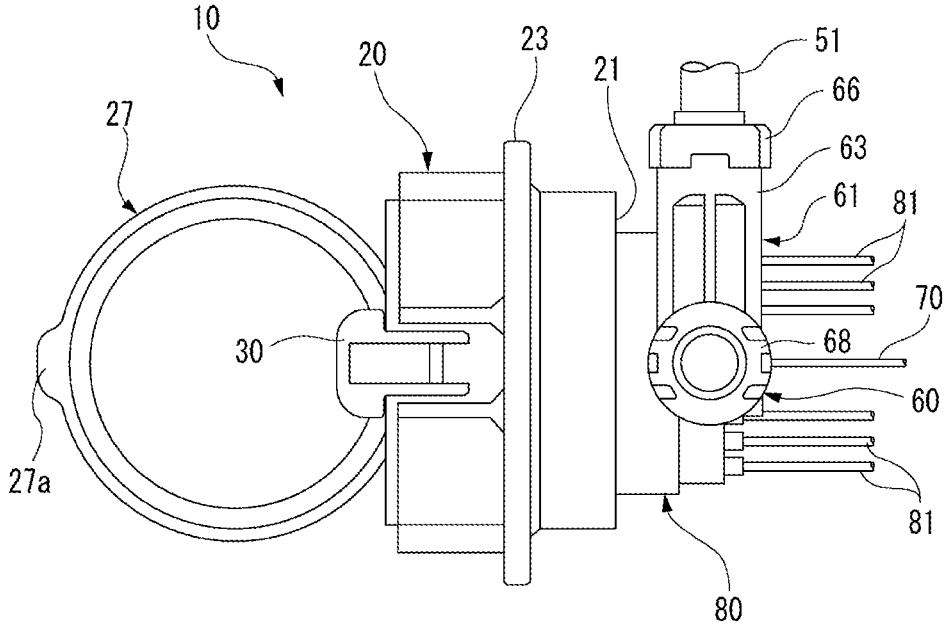
FIG. 7 is a side view of the connector in a state in which power cables are led out upward.

Incidentally, the power cables 51 are led out downward perpendicularly to the axis directions of the charging terminals 40 in the aforementioned embodiment. However, as shown in FIG. 7, the terminal holder 60 may be turned upside down so that the power cables 51 can be led out of the terminal holder 60 upward perpendicularly to the axis directions of the charging terminals 40. Also in this case, the rearward protruding dimensions of the housing 20 can be suppressed so that the connector 10 can be made compact.

Figure 8:
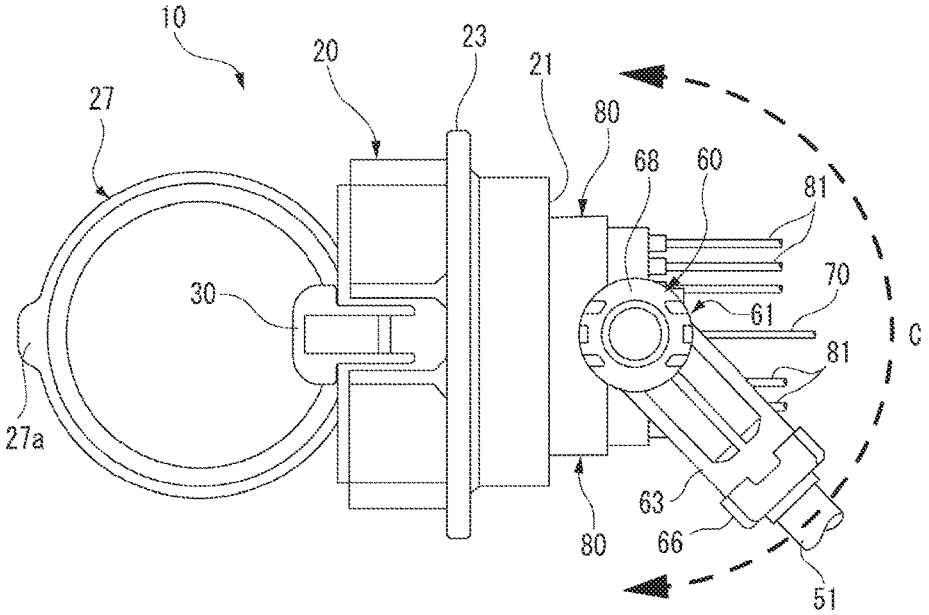
FIG. 8 is a side view of the connector for explaining adjustment of a leading-out direction of each power cable.
Figure 9:
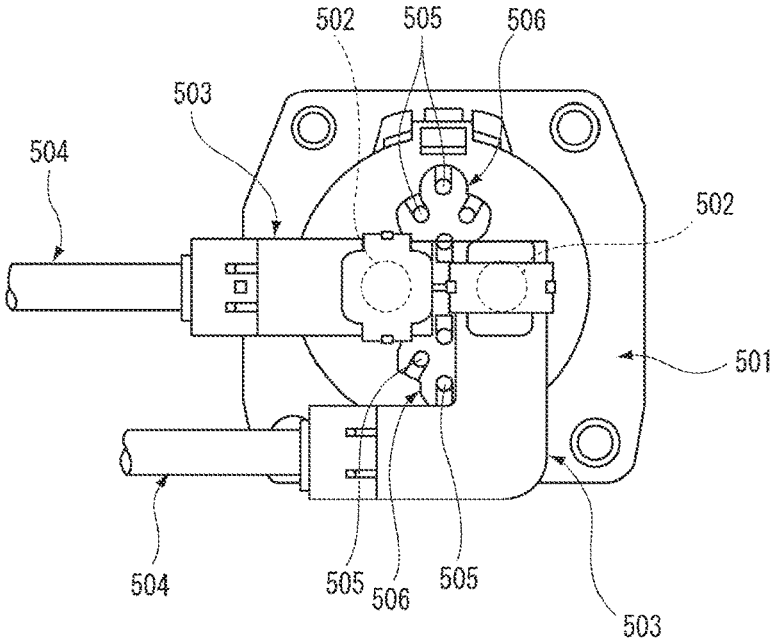
FIG. 9 is a connector back view showing a connector according to the background art.

In addition, according to the connector 10 according to the embodiment, various terminal holders 60 having different angles of electric cable inserting cylinder portions 63 with respect to terminal inserting cylinder portions 62 can be assembled as shown in FIG. 8 so that a leading-out direction of each power cable 51 is not limited to the direction perpendicular to the axis direction of the charging terminal 40 but can be changed within a range indicated by an arrow C in FIG. 8. Thus, in accordance with the layout of the structure etc. of the vehicle at the rear of the housing 20, the lead-out direction of the power cable 51 can be adjusted and routed easily.

Incidentally, each of the fasteners for fastening the terminal metal fittings 52 of the power cables 51 to the charging terminals 40 is not limited to the fastening bolt 55 in the aforementioned embodiment. For example, a fastener consisting of a rivet may be caulked to fasten and fix the terminal metal fitting 52 of the power cable 51 to the charging terminal 40.

In addition, in the aforementioned embodiment, the bolts inserted in the insertion holes 22 of the fixation flange 23 of the housing 20 are screwed into the threaded holes of the vehicle body panel. Thus, the housing 20 is fixed to the vehicle body panel. However, the structure for fixing the housing 20 to the vehicle body panel is not limited to the one using the bolts. For example, the following structure may be used alternatively. That is, stud bolts provided erectly on the fixation flange 23 are inserted into hole portions formed in the vehicle body panel, and nuts are fastened to the stud bolts from a back side of the vehicle body panel.

Further, the case where the connector 10 is used as a charging inlet connector assembled to the body of the vehicle mounted with the battery has been described in the aforementioned embodiment. However, the connector according to the invention is not limited thereto but may be used as a feeding outlet connector for feeding power from the battery of the vehicle to a device outside the vehicle.

Incidentally, the invention is not limited to the aforementioned embodiment. Modifications, improvements, etc. can be made suitably on the invention. Moreover, materials, shapes, dimensions, numbers, arrangement places, etc. of respective constituent elements in the aforementioned embodiment are not limited. Any materials, any shapes, any dimensions, any numbers, any arrangement places, etc. may be used as long as the invention can be attained.

Here, the aforementioned features of the connector according to the embodiment of the invention will be summarized and listed briefly in the following items [1] to [3] respectively.

[1] A connector (10) including:

a pair of first terminals (charging terminals 40) configured to be connected to first electric cables (power cables 51);

a housing (20) having a pair of terminal housing cylinder portions (28) configured to contain the pair of first terminals (charging terminals 40) in parallel with each other;

a pair of terminal housing portions (29) provided between the pair of terminal housing cylinder portions;

second terminals (signal terminals 82) configured to be connected to second electric cables (signal lines 81) and to be contained in the pair of terminal housing portions; and fasteners (fastening bolts 55) configured to fasten and fix terminal metal fittings (52) connected to end portions of the first electric cables to the pair of first terminals protruding from rear ends of the pair of terminal housing cylinder portions, wherein by the fasteners, the terminal metal fittings are fixed to side faces (connection faces 42*a*) of the pair of first terminals from directions intersecting with axis directions of the pair of first terminals, the side faces being opposite to faces of the pair of first terminals which face each other.

[2] The connector (10) according to the aforementioned item [1], further including: a terminal holder (60) having a pair of holder portions (61) configured to cover connection places between the pair of first terminals and the end portions of the first electric cables respectively.

[3] The connector (10) according to the aforementioned item [1] or [2], wherein the housing is configured to be fixed to a body of a vehicle, the first electric cables serving power cables (51) connected to a power supply are connected to the pair of first terminals, and the second electric cables serving signal lines (81) are connected to the second terminals, so that the power supply can be charged when a feeding connector is fitted to the connector.

What is claimed is:

1. A connector comprising:

a pair of first terminals configured to be connected to first electric cables;

a housing having a pair of terminal housing cylinder portions configured to contain the pair of first terminals in parallel with each other;

a pair of terminal housing portions provided between the pair of terminal housing cylinder portions;

second terminals configured to be connected to second electric cables and to be contained in the pair of terminal housing portions;

fasteners configured to fasten and fix terminal metal fittings connected to end portions of the first electric cables to the pair of first terminals protruding from rear ends of the pair of terminal housing cylinder portions;

a terminal holder having a pair of holder portions configured to cover connection places between the pair of first terminals and the end portions of the first electric cables respectively, such that the second electric cables are unobstructed by the terminal holder, wherein by the fasteners, the terminal metal fittings are fixed to side faces of the pair of first terminals from directions intersecting with axis directions of the pair of first terminals, the side faces being opposite to faces of the pair of first terminals which face each other;

wherein each of the holder portions has a terminal inserting cylinder portion configured to receive one of the pair of first terminals, an electric cable inserting cylinder portion configured to receive an end portion of one of the first electric cables, and a bolt inserting cylinder portion configured to receive one of the fasteners; and wherein an extending direction of the terminal inserting cylinder portion, an extending direction of the electric cable inserting cylinder portion, and an extending direction of the bolt inserting cylinder portion are substantially perpendicular to each other.

2. The connector according to claim 1, wherein the housing is configured to be fixed to a body of a vehicle, the connector is configured to be fitted to a feeding connector and to receive power from the feeding connector, the first electric cables serving power cables are configured to be connected to and charge a power supply using the received power, and the second electric cables serving signal lines are connected to the second terminals.

3. The connector according to claim 1, wherein the pair of holder portions are configured to be adjustable such that a direction of the first electric cables changes with respect to the pair of holder portions after an adjustment.

* * * * *